US011826307B2

(12) United States Patent
Yang et al.

(10) Patent No.: US 11,826,307 B2
(45) Date of Patent: Nov. 28, 2023

(54) HIGH EFFICIENCY EXTERNAL COUNTER PULSATION SYSTEM AND METHOD OF TREATMENT USING THE SYSTEM

(71) Applicant: Academia Sinica, Taipei (TW)

(72) Inventors: Fu-Liang Yang, Hsinchu (TW); Chang-Kuei Chung, Taoyuan (TW)

(73) Assignee: Academia Sinica, Taipei (TW)

( * ) Notice: Subject to any disclaimer, the term of this patent is extended or adjusted under 35 U.S.C. 154(b) by 426 days.

(21) Appl. No.: 17/019,437

(22) Filed: Sep. 14, 2020

(65) Prior Publication Data

US 2021/0259909 A1 Aug. 26, 2021

Related U.S. Application Data

(60) Provisional application No. 62/979,372, filed on Feb. 20, 2020.

(51) Int. Cl.
*A61H 9/00* (2006.01)

(52) U.S. Cl.
CPC ... *A61H 9/0092* (2013.01); *A61H 2201/1409* (2013.01); *A61H 2201/5046* (2013.01); *A61H 2201/5092* (2013.01); *A61H 2209/00* (2013.01); *A61H 2230/045* (2013.01)

(58) Field of Classification Search
CPC ..... A61H 9/0092
See application file for complete search history.

(56) References Cited

U.S. PATENT DOCUMENTS

| | | | | |
|---|---|---|---|---|
| 6,010,471 | A * | 1/2000 | Ben-Noon | A61F 13/0273 601/149 |
| 6,589,267 | B1 | 7/2003 | Hui | |
| 6,962,599 | B2 | 11/2005 | Hui | |
| 7,048,702 | B2 | 5/2006 | Hui | |
| 2003/0233118 | A1 | 12/2003 | Hui | |
| 2004/0260218 | A1 * | 12/2004 | Shah | A61H 31/006 601/152 |
| 2007/0088239 | A1 * | 4/2007 | Roth | A61H 9/0078 601/152 |
| 2011/0009784 | A1 * | 1/2011 | Li | A61H 9/0092 601/151 |
| 2011/0152734 | A1 * | 6/2011 | Zamboni | A61H 9/0078 601/134 |
| 2015/0150560 | A1 * | 6/2015 | Sato | A63B 23/0355 606/202 |
| 2019/0083353 | A1 * | 3/2019 | Khurana | A61H 9/0092 |

* cited by examiner

*Primary Examiner* — Samchuan C Yao
*Assistant Examiner* — Tina Zhang
(74) *Attorney, Agent, or Firm* — Rei-Cheng Jason Hsu

(57) ABSTRACT

An external counter pulsation system (ECP) and method for using the system to improve circulation as well as cardiovascular related diseases. The ECP system of the present invention comprises a helical air bladder for modulating blood flow of major veins and arteries of the thigh. High efficiency is realized with the helical shape of the air bladder to lower the cost, weight and size of the ECP of the present invention.

14 Claims, 14 Drawing Sheets

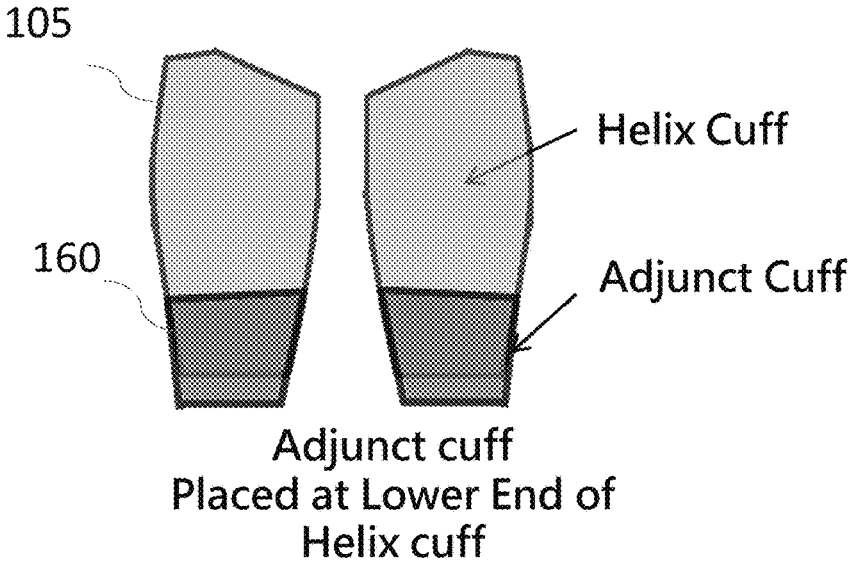
Fig. 4a
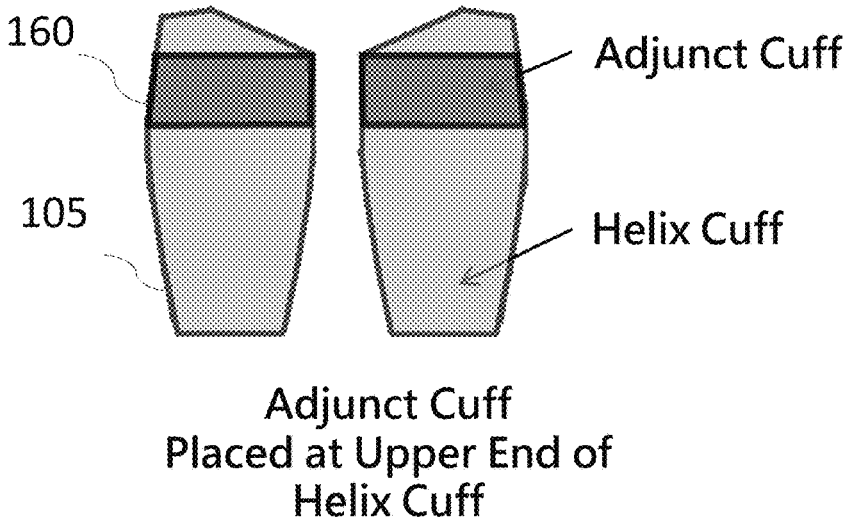
Fig. 4b
Fig. 4

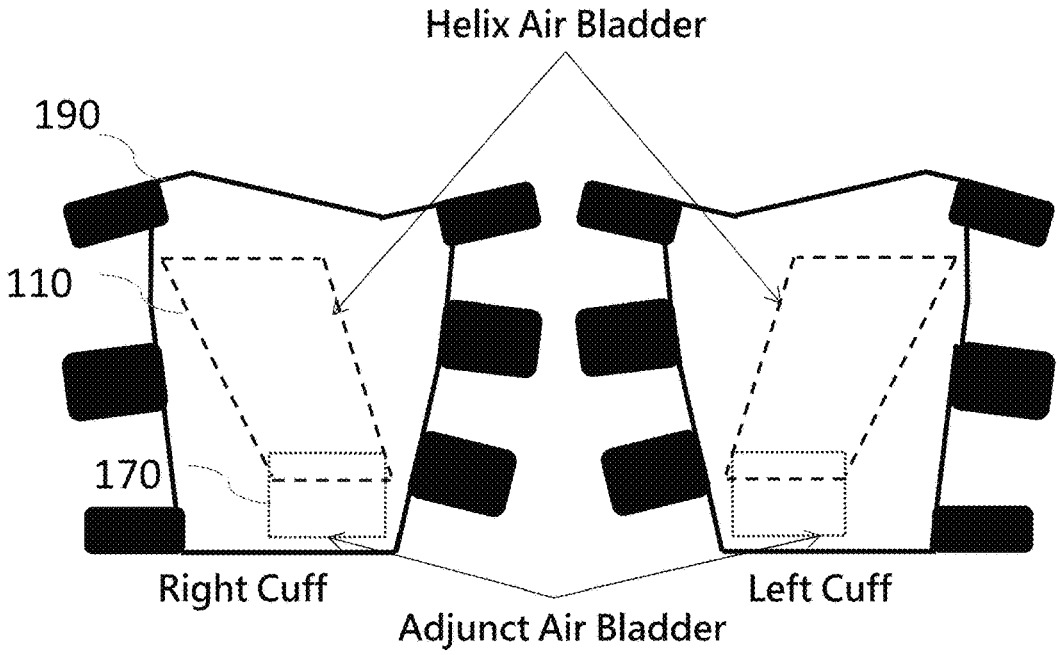
Fig. 4c
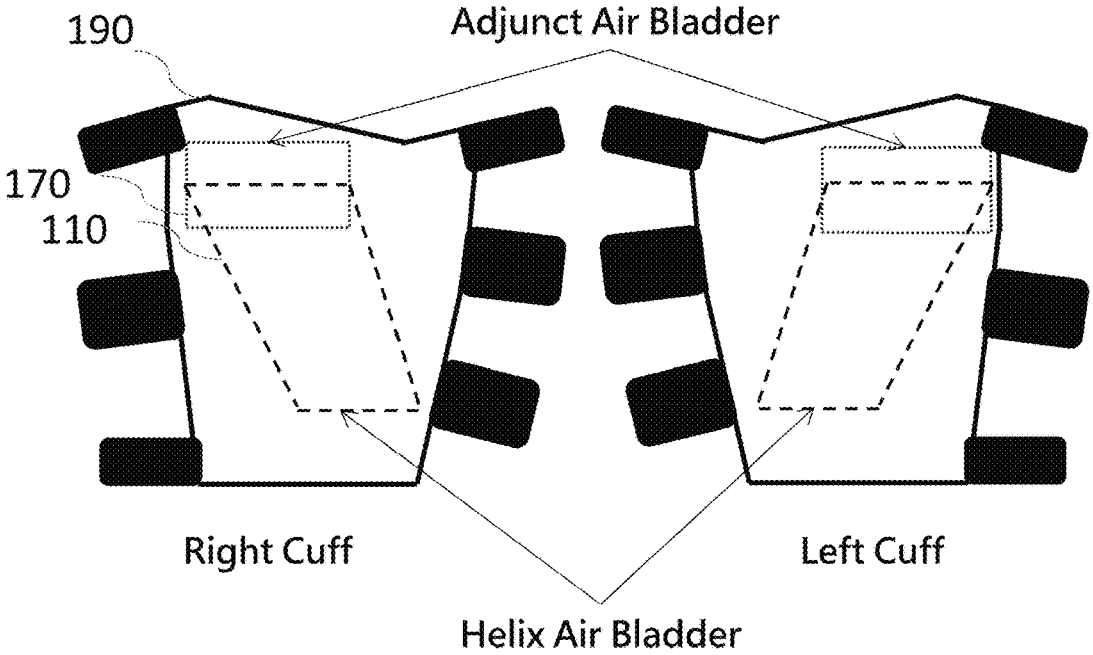
Fig. 4d
Fig. 4

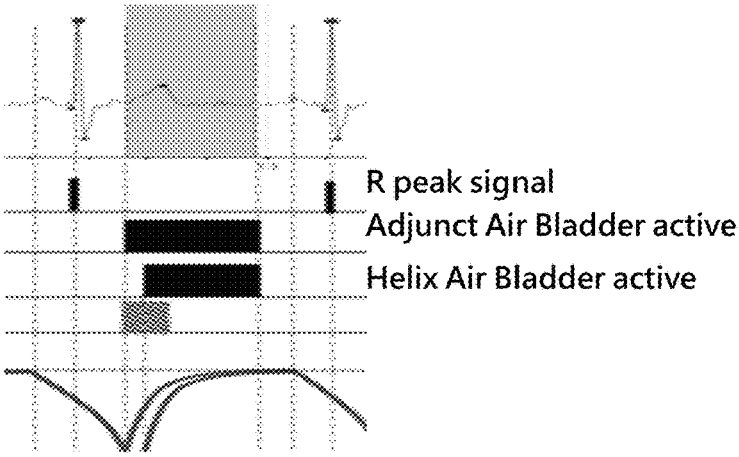
Fig. 5a
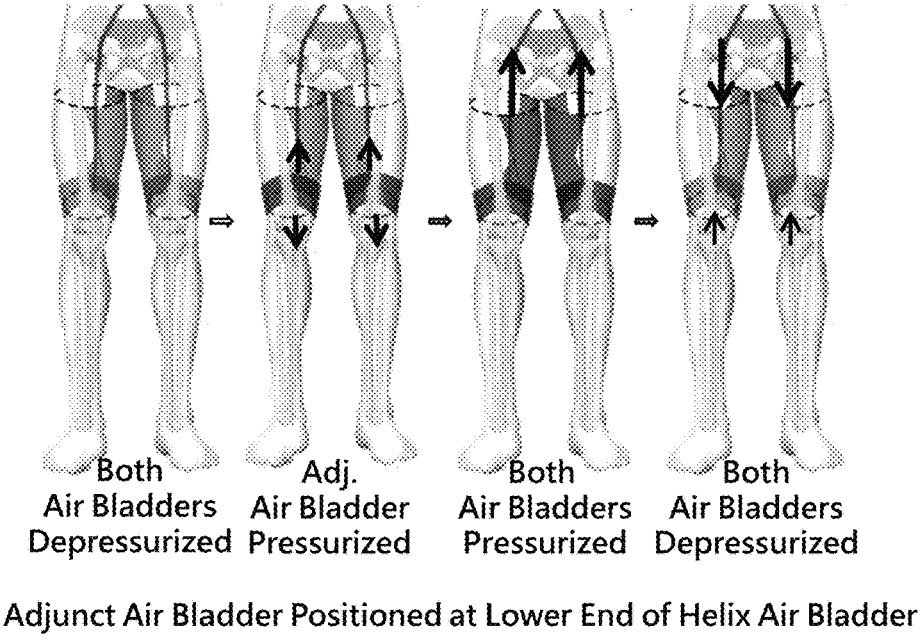
Fig. 5b
Fig. 5

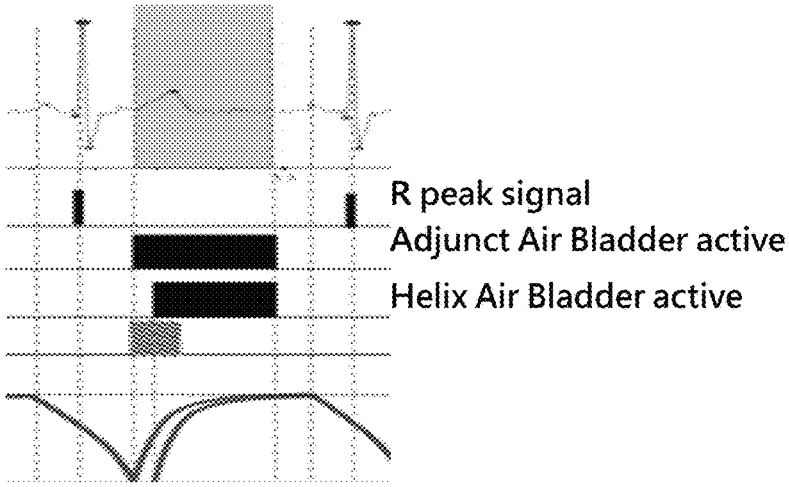
Fig. 6a
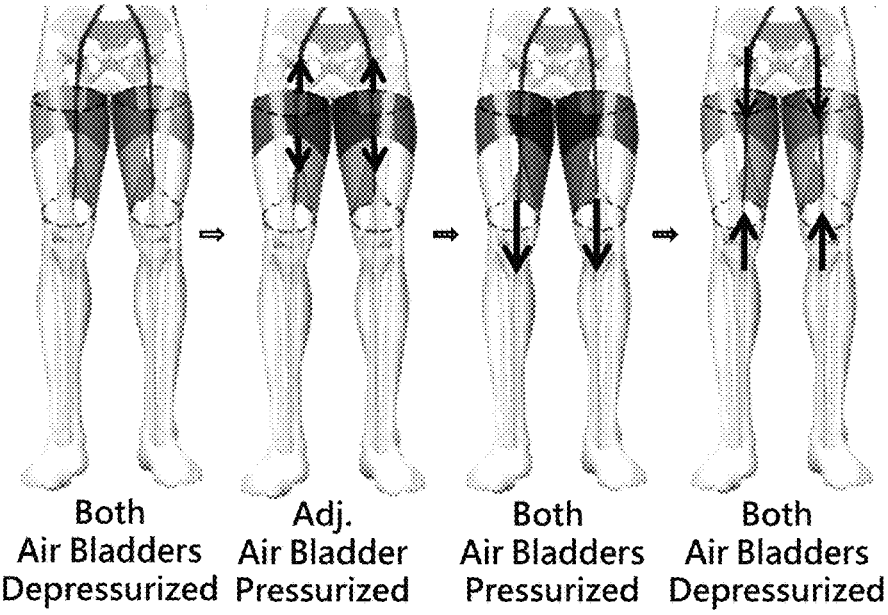
Adjunct Air Bladder Positioned at Upper End of Helix Air Bladder
Fig. 6b
Fig. 6

Fig. 12a Pre Treatment

Fig. 12b During Treatment

HIGH EFFICIENCY EXTERNAL COUNTER PULSATION SYSTEM AND METHOD OF TREATMENT USING THE SYSTEM

CROSS-REFERENCE TO RELATED APPLICATIONS

The present patent application claims priority to U.S. provisional patent application No. 62/979,372 entitled "High Efficiency External Counter Pulsation System And Method of Treatment Using the System" filed on Feb. 20, 2020 and is hereby incorporated in its entirety.

FIELD OF THE INVENTION

The present invention relates to a highly efficient external counter pulsation system and method of treatment using the system. Specifically, the present invention comprises one or more air bladders that utilize helical geometry of the major veins and arteries in users' thigh to achieve high efficiency.

BACKGROUND OF THE INVENTION

External Counter Pulsation (ECP) is a clinically proven treatment system for various diseases such as refractory angina, acute myocardial infarction, congestive heart failure and ischemia related diseases by using air bladders on the leg to modulate hemodynamic characteristics. Other applications are currently being explored in neurology and nephrology. However, current ECP systems are expensive, large, heavy and stationary. One reason is that high powered air compressors are required to operate the systems. Therefore, only hospitals and clinics are able to purchase and house them, requiring patients to travel to receive ECP treatments.

The design of the air bladders can substantially influence efficiency of an ECP system, including machine dimension and electrical power consumption. This invention discloses a novel helix air bladder-based high efficiency ECP system, in which the helix air bladder takes advantage of the helical manner that the major arteries and veins in the thigh winds around the femur to efficiently modulate blood flow by pressing on the major arteries and veins against the femur. Therefore the artery will be pressed by both the action force of helix air bladder and by the reaction force of the femur to make most use of applied air pressure. We add an adjunct bladder on one end of the helix air bladder to further confine the pressed artery blood moving towards the desired direction. Special cuffs to accommodate the air bladders are designed to ensure high air pressure transfer efficiency to artery. The invention discloses the whole air piping loop and the relevant control method to realize a high efficiency ECP system. The efficiency realized by the present invention using the novel helical air bladders substantially reduces air compressor power requirements and thereby reduces the cost as well as size and weight of the ECP system of the present invention so that owning and running the ECP system of the present invention in house is possible.

SUMMARY OF THE INVENTION

The present invention relates to an external counter pulsation (ECP) device comprising an air bladder system comprising one or more helix air bladders and one or more adjunct air bladders wherein each helix air bladder is shaped such that, when attached to a user's thigh, the helix air bladder forms a helix around the thigh that closely follow the major arteries and veins that wrap around femur bone in a manner that enables the helix air bladder to efficiently exert pressure on the major arteries and/or veins against the femur bone when the helix bladder is pressurized to effect blood flow modulation within the major arteries and veins; a valve and fluid system pneumatically connected to the air bladder system wherein the valve and fluid system is configured to pressurize and depressurize the helix air bladder and the adjunct air bladder; and a control system comprising a processor and one or more PPG sensors and one or more ECG sensors wherein the PPG and ECG sensors are connected to the user to collect PPG and ECG signals from the user and wherein the control system is electronically connected to the valve and fluid system to control the valve and fluid system to pressurize or depressurize the air bladders of the air bladder system based on signals detected by the sensors.

In an embodiment, the dimensions of the helix air bladder are determined by the anatomy of the user so that the helix air bladder can closely follow the major arteries and veins of the user's thigh. In another embodiment, helix air bladder's length L in cm is defined as height of the user/3.2−b where b is between 15 cm to 30 cm, helix air bladder's top width and helix air bladder's lower width are about 14 cm and helix angle is about 55°. In yet another embodiment, the wattage of the valve system is less than about 1500 Watts.

In an embodiment, the helix air bladder length L does not exceed 50 cm, W1 and W2 do not exceed 25 cm and 1250 $cm^2$ in area. In another embodiment, the pressure within the helix air bladder does not exceed 350 mmHg when fully pressurized. In another embodiment, the pressure of the helix air bladder is not below about 150 mmHg when fully pressurized. In yet another embodiment, the ratio of the top width of the helix air bladder W1 to the bottom width W2 of the helix air bladder is about from 1:1 to 2:1.

In an embodiment, the helix angle of the helix air bladder is between about 30° and 75°. In another embodiment, the adjunct air bladder is positioned at the lower end of the helix air bladder with the adjunct air bladder overlapping the helix air bladder. In yet another embodiment, the adjunct air bladder is positioned at the lower end of the helix air bladder without the adjunct air bladder overlapping the helix air bladder.

In an embodiment, the adjunct bladder is positioned at the upper end of the helix bladder with the adjunct air bladder overlapping the helix air bladder. In another embodiment, the adjunct bladder is positioned at the upper end of the helix bladder without the adjunct air bladder overlapping the helix air bladder. In yet another embodiment, the adjunct bladder and the helix bladder are in one single cuff.

The present invention also relates to a method for providing external counter pulsation treatment using ECP device of the present invention comprising the steps of detecting R peak of a user's heartbeat, instituting a delay of about 10 ms to 250 ms from the R peak, pressurizing the adjunct air bladder, instituting a delay of about 20 ms to 100 ms, pressurizing the helix air bladder for a therapeutically effective amount of time of about 200 ms to 600 ms, depressurizing both the adjunct air bladder and helix air bladder at about the same time, and repeating steps a-f for a therapeutically effective amount of time.

BRIEF DESCRIPTION OF THE DRAWINGS

FIGS. 4*a* and 4*b* are diagrams illustrating two different possible placements of the helix cuff 105 and adjunct cuff 160 of the present invention.

FIGS. 4*c* and 4*d* are diagrams illustrating two different possible placements of the helix air bladder 110 and adjunct air bladder 170 when they are both constructed within one cuff.

FIGS. 5*a* and 5*b* are diagrams showing the pressurization and depressurization cycles of the ECP device of the present invention 10 as they relate to cardiac cycles and blood flow when the adjunct air bladder 170 is located at the lower end of the helix air bladder 110.

FIGS. 6*a* and 6*b* are diagrams showing the pressurization and depressurization cycles of the ECP device of the present invention 10 as they relate to cardiac cycles and blood flow when the adjunct air bladder 170 is located at the upper end of the helix air bladder 110.

DETAILED DESCRIPTION OF THE PRESENT INVENTION

As used in this specification and in claims which follow, the singular forms "a", "an" and "the" include plural referents unless the context clearly indicates otherwise. Thus, for example, reference to "an ingredient" includes mixtures of ingredients, reference to "an active pharmaceutical agent" includes more than one active pharmaceutical agent, and the like.

As used herein, the term "about" as a modifier to a quantity is intended to mean+ or −5% inclusive of the quantity being modified.

The term "effective amount of time" or "a therapeutically effective amount of time" of a treatment is intended to mean a nontoxic/unharmful but sufficient amount of time required for providing the desired therapeutic effect. The time period that is "effective" may vary from subject to subject, depending on the age and general condition of the individual, the particular conditions, and the like.

Figure 1:
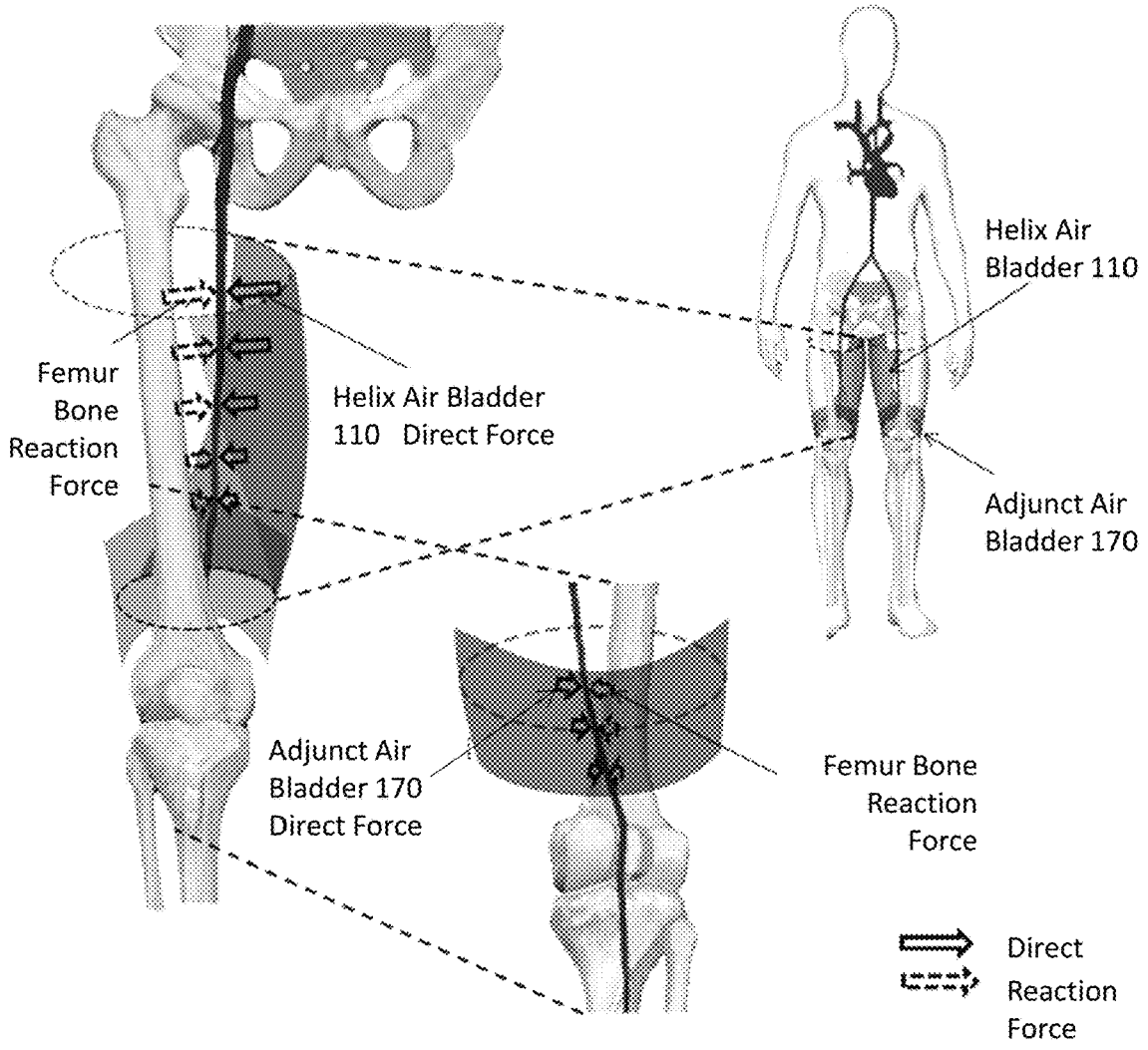
FIG. 1 is a diagram illustrating the helical geometry of major arteries and veins in the thigh of a user and an embodiment of the helix air bladder of the present invention 10.

The ECP device 10 of the present invention is capable of achieving miniaturization, low energy consumption and low device cost as compared to prior art ECP devices. This is possible because the ECP device 10 of the present invention takes advantage of the geometry of major arteries and veins in the thigh which wind around the femur in a helical manner shown in FIG. 1. Specifically, as shown in FIG. 1, the major arteries and veins start in front of the femur in front of the pelvic bone, winds around the femur in a helical fashion towards the inner thigh and ends up behind the femur behind the knee before travelling farther down the leg. As shown in FIG. 1, the helix air bladder 110 is specifically shaped to take advantage of this particular anatomy so that air bladder 110 focuses its energy only on the area of the thigh required to press the major veins and arteries against the femur bone in order to modulate blood flow of the major arteries and veins while wasting little energy on other areas of the thigh. The efficiency achieved means that a much smaller and less powerful air compressor is required for achieving the same or better therapeutic results compared to traditional ECP. For example, the power consumption of the present invention is below about 500, 600, 700, 800, 900, 1000, 1250 or 1500 Watts as compared to around 2500 Watts energy consumption of the typical commercial units currently available. In addition, the miniaturization renders the ECP device of the present invention 10 easy to handle, even portable, at less than about 20, 25 or 30 kg, and cost substantially less than existing ECP devices which are typically so heavy that they are made to be stationary. This means that users may easily own and operate the ECP device of the present invention 10 at home rather than having to travel to a clinic for treatment.

Figure 2:
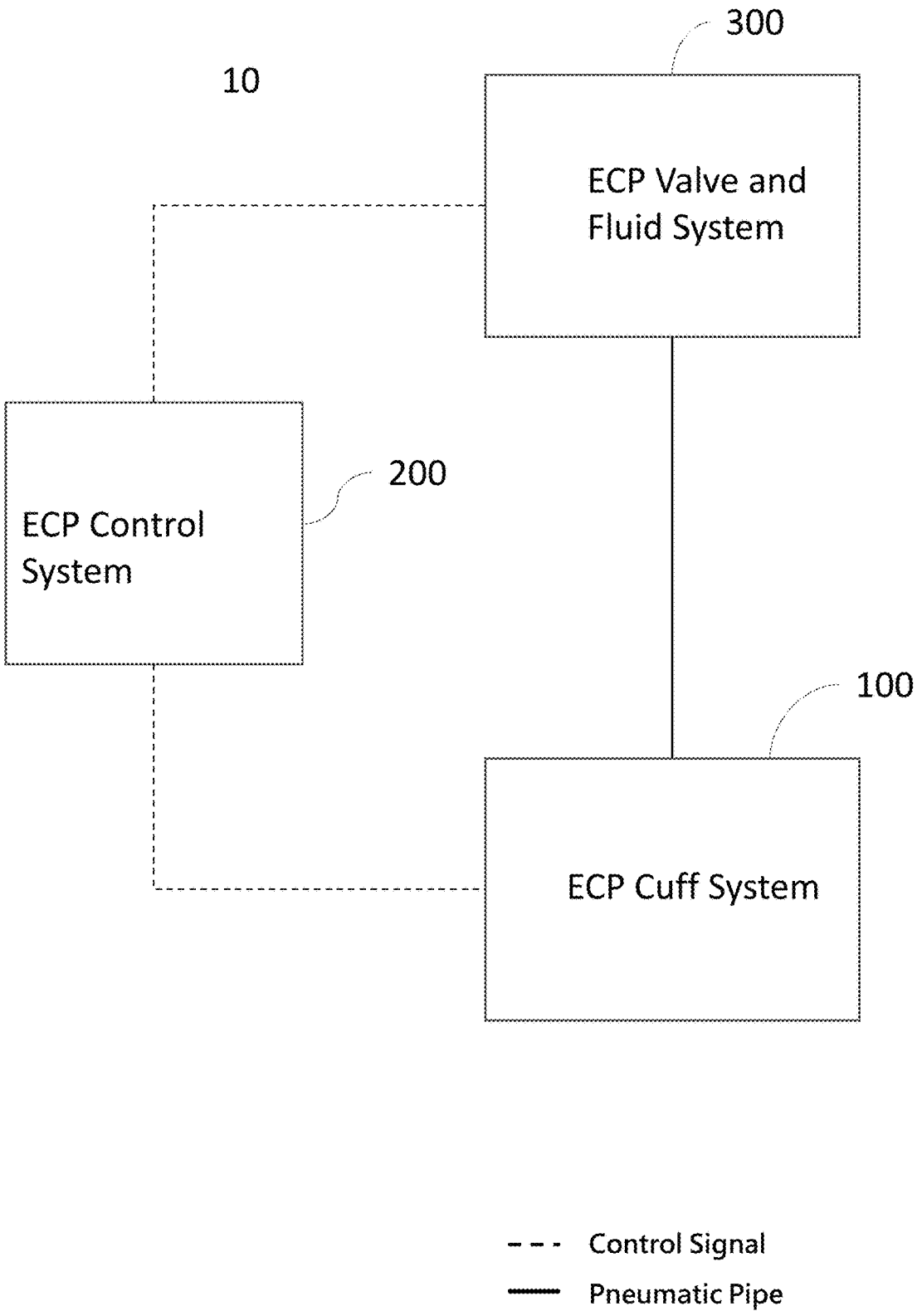
FIG. 2 is a high level block diagram of the present invention 10.

FIG. 2 is a high level depiction of the ECP device 10 of the present invention 10 comprising an air bladder system 100, a control system 200 and a valve and fluid system 300.

Figure 3:
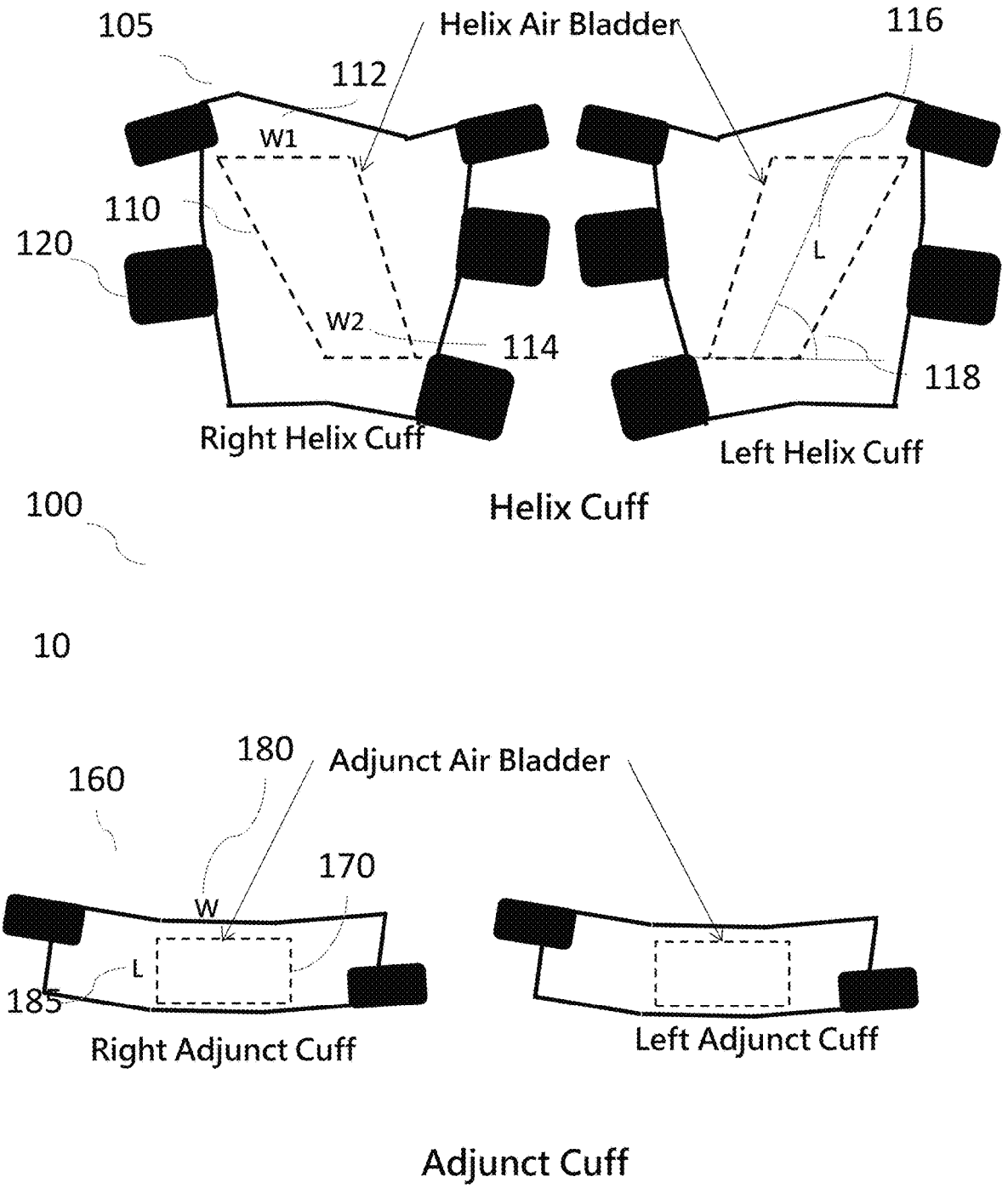
FIG. 3 is a detailed diagram of an embodiment of helix cuff 105 and adjunct cuff 160 of the present invention.

FIG. 3 depicts an embodiment of the cuff system 100. As shown in FIG. 3, the helix cuff system 100 comprises a helix cuff 105 and a helix air bladder 110. In an embodiment, the helix air bladder 110 comprises an upper width W1 112, lower width W2 114, length L 116 and helix angle 118, where length L 116 is the straight line between the midpoint of width W1 112 and midpoint of width W2 114. Helix angle is the angle between length L 116 and horizontal line parallel to the level ground when the cuff is worn by the user standing upright. If W2 is designed as parallel to this horizontal line as illustrated in FIG. 3, the helix angle would be the angle between width W2 and length L 116. In another embodiment, the helix cuff 105 further comprises one or more cuff fasteners 120.

In an embodiment as described above, the helix air bladder 110 is placed over major artery and or vein of the inner thigh such that the helix shape of the air bladder 110 follows the major arteries and veins that wrap around the femur as shown in FIG. 1. Upper width W1 112, lower width W2 114, length L 116 and helix angle 118 may differ depending on factors such as location of placement and biometrics of the user such as sex, height, weight, BMI, age, etc. . . . in order to better conform to the major arteries and or veins around the femur. In one embodiment, the helix angle 118 is about between 30° to 75°, 40° to 65° or about 55°. In one embodiment, the helix air bladder's upper width W1 112 is wider than the lower width W2 114 as shown in FIG. 3. In another embodiment, the ratio of W1 112:W2 114 is between about 2:1 to 1:1, about 1.9:1 to 1.1:1, about 1.8 to 1.2:1, about 1.7:1 to 1.3:1, about 1.6:1 to 1.4:1 or about 1.5:1. The fact that W1 112 is wider than W2 114 helps to direct the blood upwards towards the torso when the helix air bladder 110 is inflated as shown in FIGS. 4*a* and 4*c*. In one embodiment, the ratio of the width W1 112 of the top of the helix air bladder 110 to the length of the air bladder L 116 is about 1:2 to 1:4 or about 1:3.

In one embodiment, the helix air bladder 110 only covers the thigh area. In another embodiment, the helix air bladder 110 does not cover the entire thigh but just enough area over the major artery or vein over the femur as necessary to therapeutically effectively modulate blood flow so that the cuff system 100 and ECP device 10 overall may be miniaturized. In an embodiment, L 116, W1 112 and W2 114 are dependent on the biometrics of a user such as height and/or weight of the user. For example, in an embodiment: L=(User Height/3.2)−b where b is between about 15 cm to about 30 cm. So that if user height is 165 cm, L can be between about 21.6 cm and 36.6 cm and W1 112 is about 14 cm and W2 114 is about 14 cm.

In one embodiment, as shown in FIG. 3, the ECP device of the present invention 100 further comprises an adjunct cuff 160. In an embodiment, the adjunct cuff 160 comprises an adjunct air bladder 170 which assists the helix air bladder 110 in modulating blood flow towards or away from the user's torso as will be described in further detail below in connection with FIGS. 4-6. As with the design considerations for the helix air bladder 110, width W 180 and length L 185 of the adjunct air bladder 170 should be minimized to reduce power and size requirements of the air compressor used to pressurize it but still provide adequate assistance to the helix air bladder 110 as described further in connection with FIG. 4. However, the width W 180 of the adjunct air bladder 170 should be wide enough to fully encompass the W2 114 width of the helix air bladder 110 if the adjunct cuff 160 is placed at the lower end of the helix cuff 105 as illustrated on FIGS. 4*a* and *c* or the W1 width 112 if the adjunct cuff 160 is placed at the upper end of the helix cuff 105 as illustrated on FIGS. 4*b* and *d*. In addition, the length L 185 and width W 180 of the adjunct air bladder 170 should be sized and the pressure provided by the air compressor should be high enough to provide adequate force in assisting the helix air bladder 110 in modulating blood flow towards the desired direction as described in different configurations below in connection with FIG. 4. In one embodiment, the ratio of the width W 180 to length L 185 of the adjunct air bladder 170 is about 1.5:1 to 4:1, about 2:1 to 3:1 or about 2.5:1. In another embodiment, the width W 180 of the adjunct air bladder is about 8 cm to 30 cm, about 16 to 24 cm or about 22 cm.

In one embodiment as illustrated in FIGS. 4*a-d*, the adjunct air bladder 170 may be positioned over the helix air bladder 110 in different configurations. In one embodiment, the adjunct air bladder 170 may be positioned over the lower end of the helix air bladder 110 as shown in FIG. 4*a*. In an embodiment, the adjunct air bladder 170 abuts the lower end of the helix air bladder at the bottom of W2 114 and overlaps the helix air bladder 110. In yet another embodiment, the helix air bladder 110 and adjunct air bladder 170 may be built in one single cuff as shown in FIG. 4*c*.

In another embodiment, as shown in FIG. 4*b*, the adjunct air bladder 170 may be positioned over the upper end of the helix air bladder 110. In an embodiment, the adjunct air bladder 170 abuts the upper end of the helix air bladder at the top of W1 112 and overlaps the helix air bladder 110. In another embodiment, the helix air bladder 110 and adjunct air bladder 170 may be built in one single cuff as shown in FIG. 4*d*.

In an embodiment, the adjunct air bladder 170 is pressurized before the helix air bladder 170 so as to affect direction of blood flow when the helix air bladder 110 is subsequently pressurized. Specifically, as shown in FIG. 5, when the adjunct air bladder 170 is positioned at the lower end of the helix air bladder 110 and the adjunct air bladder 170 is pressurized before the helix air bladder 110, the direction of the majority of blood flow caused by the cuff system 100 is first upwards towards the torso of the user since adjunct air bladder 170 prevents downward blood flow. In an embodiment, the adjunct air bladder 170 should be wide enough to at least cover the entire width W1 112 of the helix air bladder. In addition, air pressure of adjunct air bladder 170 should be high enough to stop over about 90%, about 80%, about 70% or about 60% of the blood flow downwards when pressurized. In an embodiment, the pressure in the air bladders 110 and 170 is about 150 mmHg to 350 mmHg, about 200 mmHg to 300 mmHg or about 250 mmHg Subsequently, when both air bladders 170 and 110 depressurize, majority of blood flow caused by the cuff system 100 is downwards away from the torso of the user. And in FIG. 6 in an embodiment in which the adjunct air bladder 170 is positioned at the upper half of the helix air bladder 110 and when the adjunct air bladder 170 is pressurized before the helix air bladder 110, the direction of the majority of blood flow caused by the cuff system 100 is first downwards towards the feet of the user since adjunct air bladder 170 prevents upward blood flow. Subsequently, when both air bladders 170 and 110 depressurize at about the same time, the majority of blood flow caused by the cuff system 100 is upwards towards the torso of the user. Therefore, air pressure of the adjunct air bladder 170 should be high enough to stop over 90%, about 80%, about 70% or about 60% of the blood flow upwards when pressurized. In an embodiment, the pressure in the air bladders 110 and 170 is about 150 mmHg to 350 mmHg, 200 to 300 or about 250 mmHg. As illustrated in FIGS. 5 and 6, placement of the air bladders 110 and 170 allows the user to target different areas of the body at different strengths of treatment.

Figure 7:
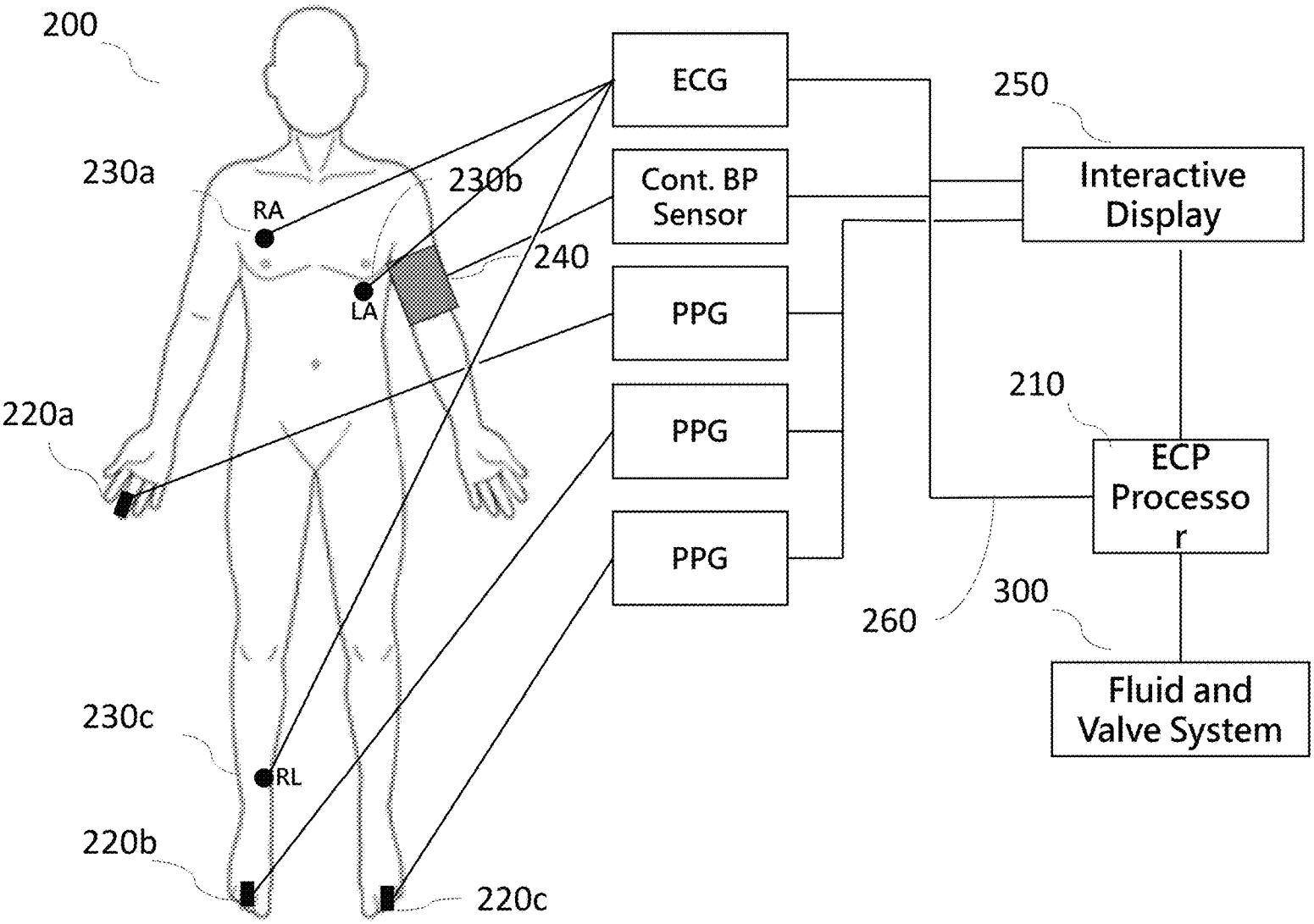
FIG. 7 is a block diagram illustrating an embodiment of the ECP control unit 200 of the present invention.

In an embodiment, as shown in FIG. 7, the ECP device 10 of the present invention further comprises an ECP controller system 200 configured to control various aspects of the ECP device 10 of the present invention including but not limited to interaction with the user, collection and analysis of user's biometric data and interaction with valve system 300 to pressurize/depressurize air bladders 110 and 170. In an embodiment, the ECP controller system 200 preferably comprises an ECP processor 210, one or more heartbeat sensors 220, 230, 240 and an interactive display unit 250. In an embodiment, the ECP processor 210 is connected to the interactive display unit 250, the heartbeat sensors 220, 230 and 240 via electronic connection 260. In addition, in an embodiment, the ECP processor 210 is further connected to a valve and fluid system 300 via electronic connection 260 as described in further details below in connection with FIGS. 8 and 10.

In an embodiment, the ECP processor 210 preferably comprises a processor configured to send, receive and process signals including but not limited to signals to and from the user via interactive display 250, signals to and from the valve and fluid system 300 as well as signals related to biometric data of the user such as heartbeat information collected by the heartbeat sensors 220, 230 and 240. In this way, the ECP processor 210 is configured to control various aspects of the ECP device 10 of the present invention such as pressure in the helix air bladder 110 and the adjunct air bladder 170 based on the various signals processed.

As shown in FIG. 7, in an embodiment, the PPG heartbeat sensor 220 may comprise a finger sensor 220*a* and two toe sensors 220*b* and 220*c*. In an embodiment, the ECG heartbeat sensor 230 may comprise a right and left chest sensor 230*a* and 230*b*. In addition, the ECG heartbeat sensor 230 may further comprise leg sensors 230*c*. In an embodiment, the continuous blood pressure sensor 240 comprises a blood pressure cuff over the arm of the user.

The display 250 is preferably a touchscreen that allows the user to interact with the ECP device 10 of the present invention such as triggering ECP treatment, input user information, system settings, etc. . . . . User information may comprise biometric information of the user such as sex, height, weight, BMI, age, etc. Input information may also comprise systems settings such as type of ECP treatment and time period of treatment, maximum and/or minimum pressure, etc. . . . . Output of information may comprise type of treatment, progress of treatment, etc. . . . . .

Figure 8:
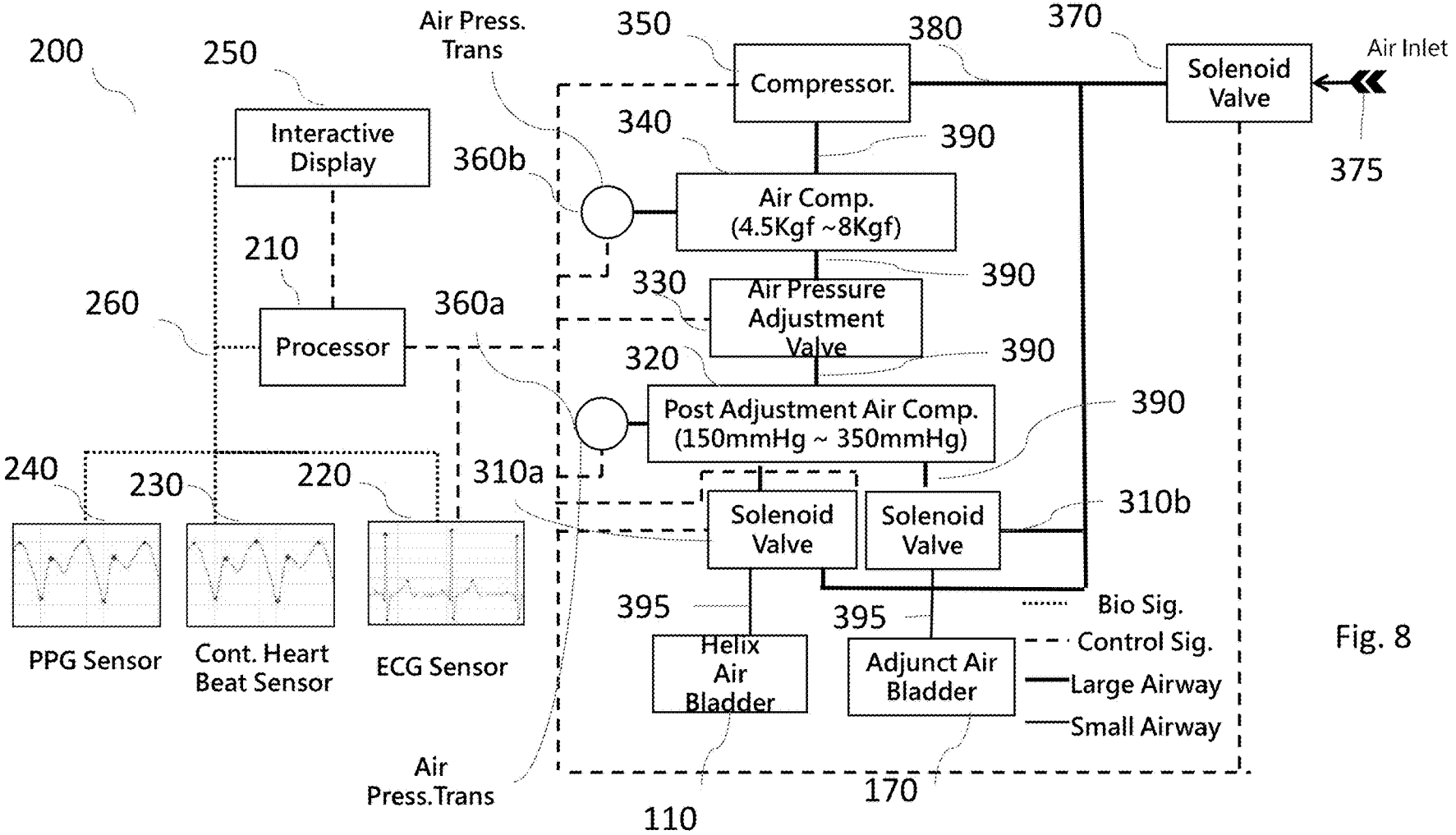
FIG. 8 is a block diagram depicting an embodiment of the ECP control unit 200 and the fluid and valve system 300 of the present invention.
Figure 9:
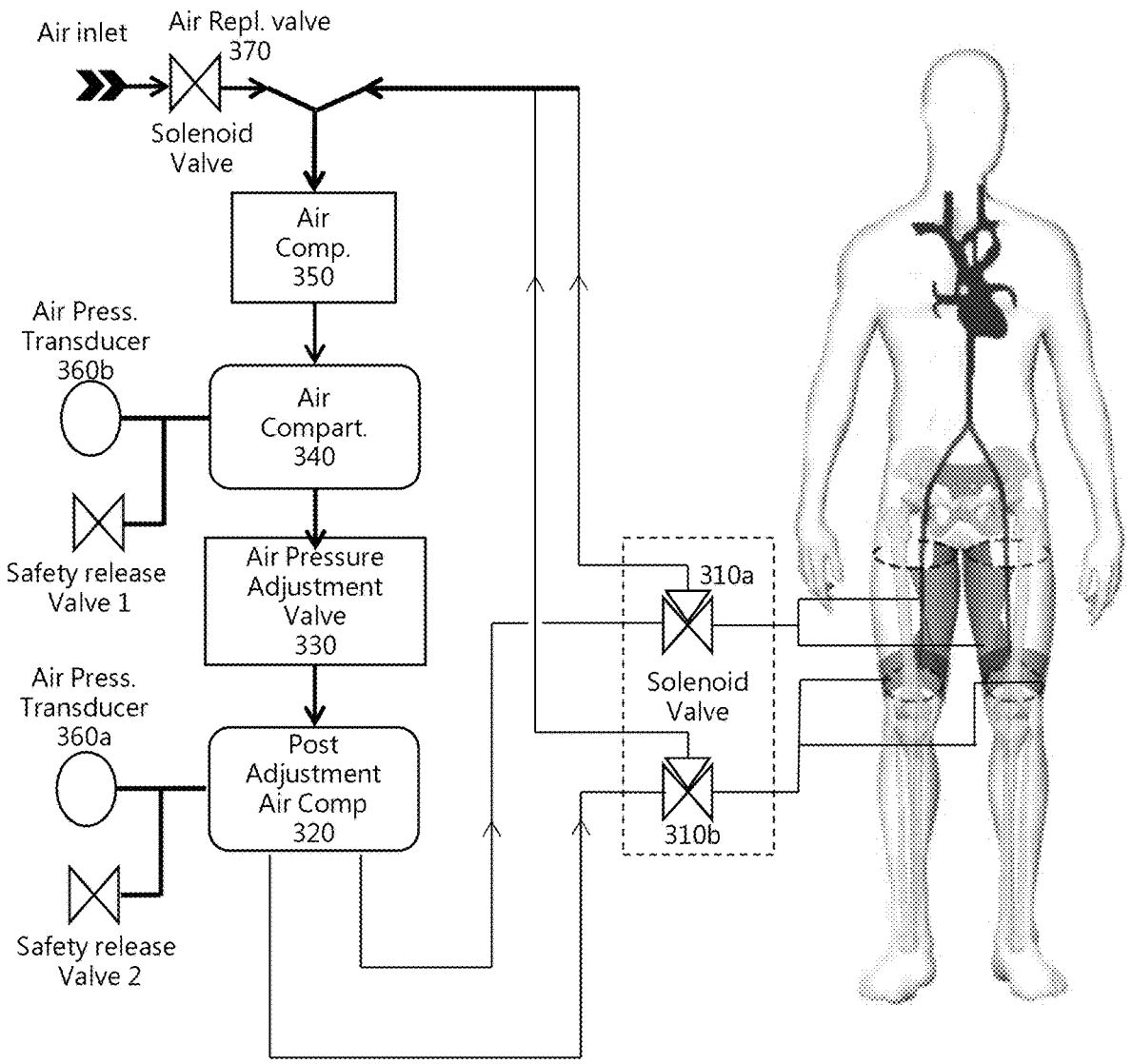
FIG. 9 is a block diagram depicting an embodiment of the fluid and valve system 300 of the present invention.

In an embodiment, as shown in FIGS. 8 and 9, the ECP device of the present invention 10 further comprises a valve and fluid system 300 that works with the ECP controller system 200 to control pressure within the ECP device of the present invention 10, including pressure within the valve and fluid system 300 as well as the cuff system 100. In an embodiment, the valve and fluid system 300 comprises one or more air bladder valves 310, a post adjustment air compartment 320, an air pressure ratio adjustment valve 330, an air compressor air compartment 340, an air compressor 350, air pressure to electric signal transducer 360, air inlet valve 370, air inlet 375 and a series of large airways 380 and small airways 390 and 395. In an embodiment, the large airways 380, which are used for establishing negative pressure, have diameters of about 1 cm to 10 cm, and the small airways 390 and 395 have diameters of about 0.4 cm to 2 cm.

In an embodiment, the air bladder valves 310 each preferably comprises a valve configured to regulate pressure of the cuff system 100 based on electronic signals received from the ECP control system 100. In an embodiment, air bladder valves 310 are solenoid valves. The post adjustment air compartment 320 preferably comprises an air compartment capable of storing pressurized air for pressurizing the air bladders 110 and 170. In an embodiment, the pressure within the air compartment 320 is from 150 mmHg to 350 mmHg, 200 mmHg to 300 mmHg or about 250 mmHg Each valve 310*a* and 310*b* is connected on one side to the post adjustment air compartment 320 via airway 390 and to helix air bladder 110 and adjunct air bladder 170 via airway 395 on the other side of the valve. Each valve 310 is additionally connected to air inlet valve 370 and compressor 350 via airway 380 through which air bladders 110 and 170 may be depressurized. Moreover, each valve 310 is electronically connected to ECP processor 210 via electronic connection 260 so that ECP processor 210 may electronically trigger valves 310 to pressurize and depressurize air bladders 110 and 170.

In an embodiment, the air compressor air compartment 340 comprises an air compartment that connects to the post adjustment air compartment 320 via the air pressure ratio adjustment valve 330. In an embodiment, the air pressure ratio adjustment valve 330 further connects to the ECP processor 210 via electronic connection 260. In this way, the air pressure ratio adjustment valve 330 is configured to maintain air pressure within the two air storages 320 and 340 based on signals from the ECP processor 210. In an embodiment, the air pressure in the post adjustment air storage 320 is maintained at between about from 150 mmHg to 350 mmHg, 200 mmHg to 300 mmHg, or about 250 mmHg while the air pressure within the compressor air storage 340 is maintained at about 4 kgf to 8 kgf, about 5 kgf to 7 kgf or about 6 kgf.

In an embodiment, the air compressor 350 comprises an air compressor configured to provide positive pressure to airway 390 when air inlet valve 370 is open and negative pressure to airway 380 when air inlet valve 370 is closed to air inlet 375 in order to facilitate replenishing air to the air compartment 340 and depressurizing the air bladders 110 and 170, respectively. In an embodiment, the air compressor 350 is capable of running at about 1700 rpm at about 130 L/m of flux at pressure up to about 8 kgf. The air inlet valve 370 preferably comprises a valve that connects to the compressor 350 via airway 380 on one end and to an air inlet 375 on the other end. In an embodiment, the air inlet valve 370 comprises a solenoid valve.

Lastly, transducers 360 preferably comprises transducers that each translates pressure to electric signal. Each transducer 360 preferably connects on one side to one of the air compartments 340 and 320, respectively, via airway 390 and to the ECP controller processor 210. In this way, the valve system 300 is configured to transmit air pressure information to ECP controller system 200 via transducers 360. As mentioned above, the ECP controller processor 210 is connected to solenoid valve 310, the air pressure ratio adjustment valves 330, air inlet valve 370 and air compressor 350 so that the ECP controller system 200 is configured to send electronic signals to control the valves 330 and 370 and air compressor 350 based on air pressure information from transducers 360*a* and 360*b*.

In an embodiment, when ECP processor 210 send a signal to valve 310, valve 310 pressurizes air bladders 110 and 170 by connecting them to post adjustment air compartment 320, supplying pressurized air to the air bladders 110 and 170. To depressurize air bladders 110 and 170, ECP processor 210 stops any signal to valve 310 so that valve 310 defaults to disconnecting the air bladders 110 and 170 from air compartment 320 and connecting them instead to airway 380. In addition, ECP processor 210 also sends a signal to air inlet valve 370 to close the air inlet so that compressor 350 is able to establish negative pressure in airway 380 to rapidly depressurize the air bladders 110 and 170. In an embodiment, the negative air pressure in airway 380 is about 80 mmHg to 120 mmHg, about 90 mmHg to 110 mmHg or about 100 mmHg.

Figure 10:
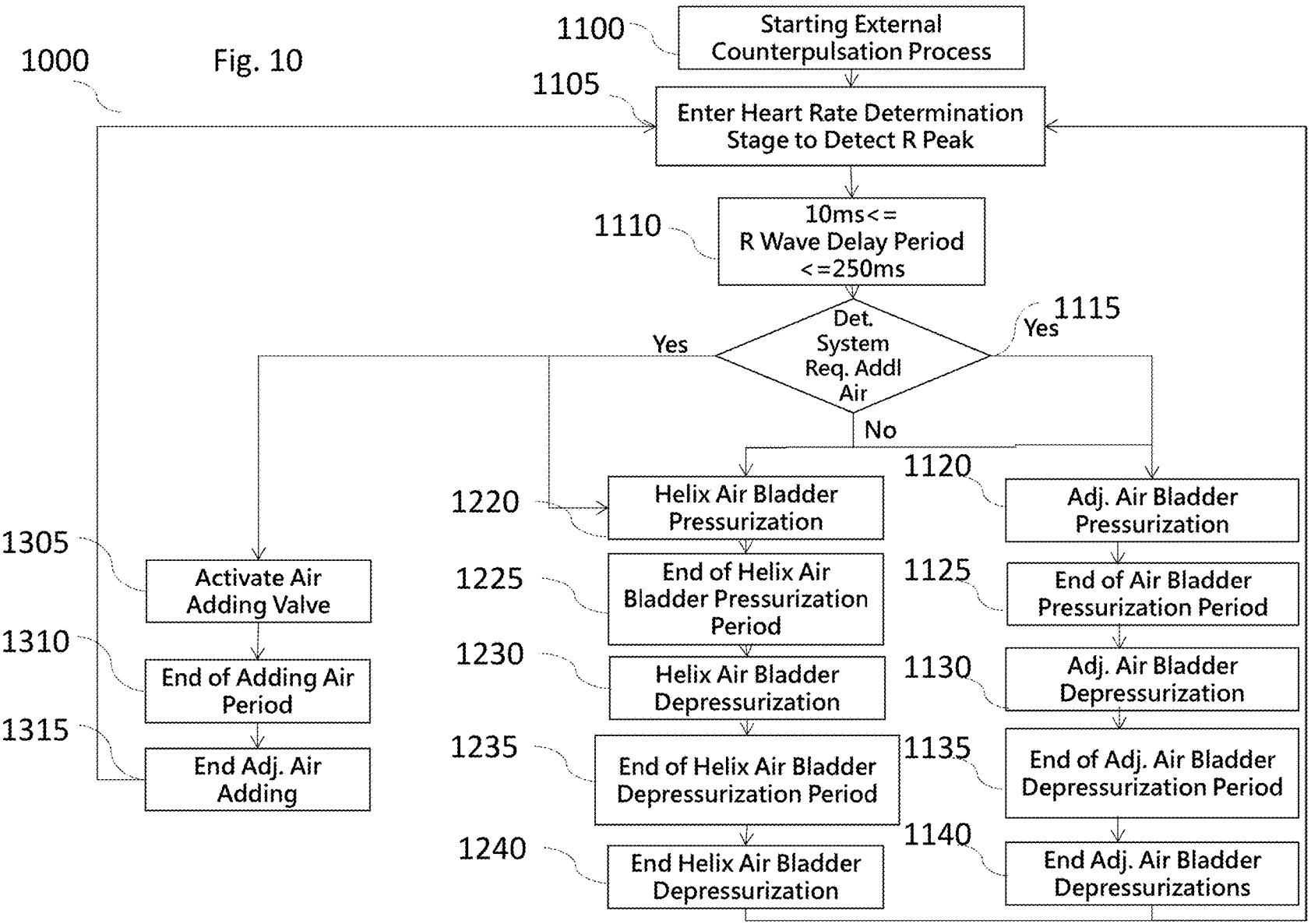
FIG. 10 is a flow chart illustrating an embodiment to of the method of using the ECP device of the present invention 10.
Figure 11:
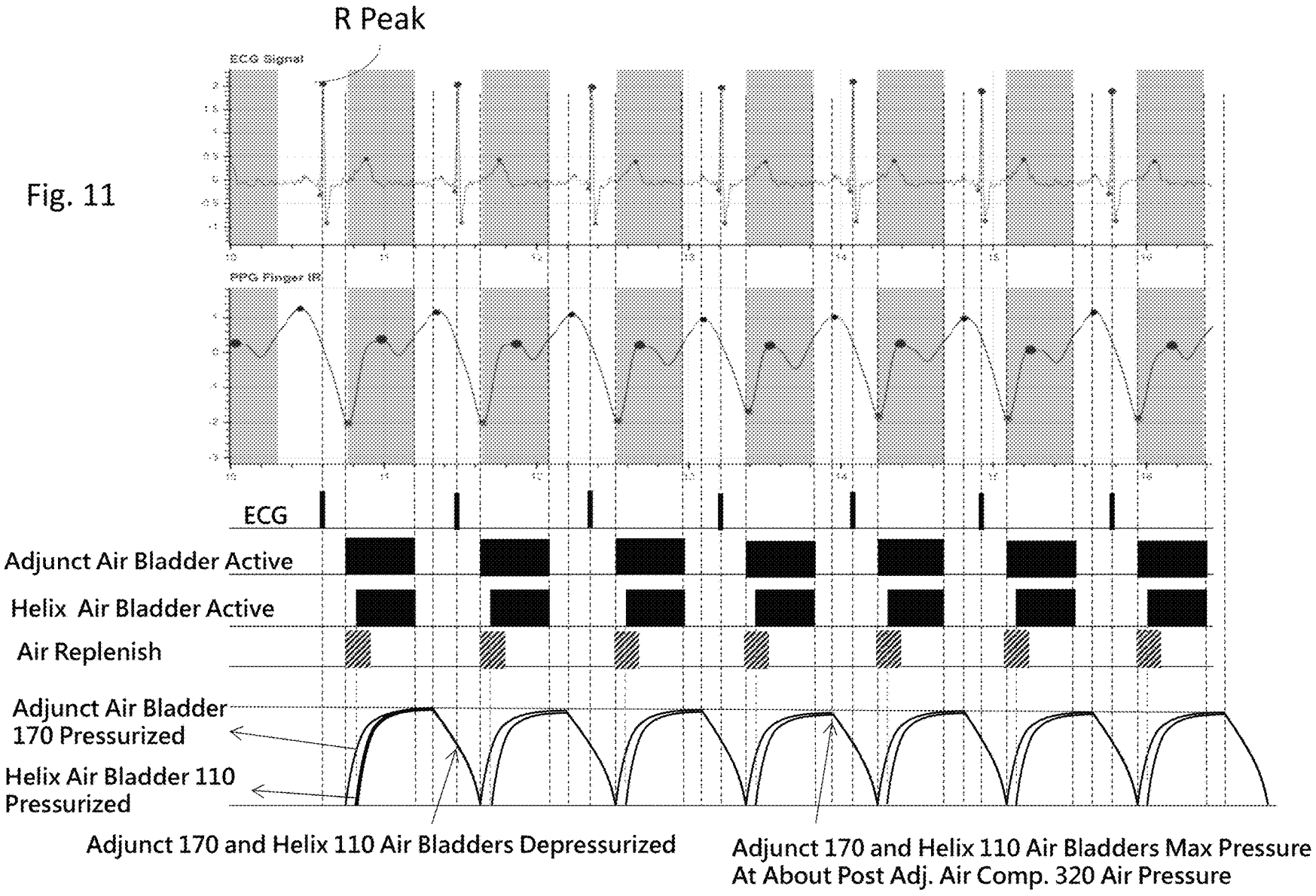
FIG. 11 is a combination of PPG and ECG charts with charts showing pressurization and depressurization of helix air bladder 110 and adjunct air bladder 170 wherein the diagrams are synched in time to illustrate an embodiment of the method of treatment using the ECP device of the present invention 10.

FIG. 10 illustrates the method for providing External Counter Pulsation of the present invention 1000. The method of the present invention may be provided to treat diseases such as stroke, dementia, and arteriosclerosis but may also be provided merely to improve blood flow in general. As illustrated in FIG. 11, in step 1100, the method of the present invention is triggered to begin. In one embodiment, step 1100 may be manually triggered by a person such as the user via interactive display 250. In another embodiment, step 1100 may be triggered automatically by signals from the heart rate sensors 220, 230, 240. Next in step 1105, the ECP processor 210 reads and analyzes various biometric data such as but not limited to those input by the user via display as well as ECG 220, PPG 230, continuous blood pressure sensor 240, etc. . . . in order to determine the R peak of the user's heart rate. Once the R peak has been determined in step 1105 using various methods well known to persons in the art, the ECP processor 210 institutes a delay of between about 10 ms to about 250 ms, about 50 ms to about 200 ms or about 100 ms to about 150 ms from the R peak in step 1110. During the delay, in step 1115, a determination is made as to whether additional air is required in the valve and fluid system 300. In one embodiment, step 1115 is performed by the ECP processor 210 based on air pressure signals from transducers 360*a* and 360*b* which provide air pressure information for the air compartments 320 and 340, respectively. If in step 1115 it is determined that additional air is not required in either air compartments 320 and 340, for example, if the pressure within air compartments 320 and 340 is maintained between about 150 mmHg to 350 mmHg, 200 mmHg to about 300 mmHg, or about 250 mmHg, then no additional air is required, in step 1120, the ECP processor 210 triggers valve 310*b* to connect adjunct air bladder 170 to air compartment 320 to pressurize adjunct air bladder 170. In addition, in step 1220, the ECP processor 210 triggers valve 310*a* to connect helix air bladder 110 to air compartment 320 to pressurize helix air bladder 110 using air from air compartment 320. In an embodiment, step 1120 is performed before step 1220 wherein a delay of about 30 to 70 ms, or about 40 to 60 ms or about 50 ms is instituted between steps 1120 and 1220.

In step 1125, the end of the adjunct air bladder 170 pressurization period is reached. In an embodiment, the pressurization time period is about 200 ms to 600 ms, 250 ms to 550 ms, 300 ms to 500 ms or about 400 ms. In an embodiment, the pressurization time period maybe determined based upon heart rate according to the table below:

TABLE 1

| Heart Rate (per minute) | Pressurization Period (ms) |
|---|---|
| 105-120 | about 280 |
| 100-105 | about 300 |
| 95-100 | about 320 |
| 90-95 | about 340 |
| 85-90 | about 360 |
| 80-85 | about 380 |
| 75-80 | about 400 |
| 70-75 | about 440 |
| 60-65 | about 460 |
| 55-60 | about 480 |
| 50-55 | about 500 |
| <=50 | about 600 |

In an embodiment, the ECP processor 210 performs step 1125 by keeping track of this time period. Next in step 1130, the adjunct air bladder 170 is depressurized. In an embodiment, the depressurization is performed by the ECP processor 210 sending a signal to valve 310*b* to disconnect air bladder 170 from air compartment 320 to connect air bladder 170 to airway 380 as well as to close air inlet valve 370 to allow air compressor 350 to establish negative pressure in airway 380 to facilitate rapid depressurization of the adjunct air bladder 170. Next, in step 1135, the end of adjunct air bladder 170 depressurization period is reached. In an embodiment, the ECP processor 210 performs step 1135 by keeping account of this time period. In step 1140, adjunct air bladder 170 depressurization process is stopped and the process repeats from step 1105 if therapeutic effect has not been fully realized.

Similarly, after maintaining air pressure in the helix air bladder 110 for a preset time period the end of the helix cuff 105 pressurization period in step 1225. In an embodiment, the pressurization time period is about from 200 ms to 600 ms, 250 ms to 550 ms, 300 ms to 500 ms or about 400 ms. In another embodiment, the air pressure in the helix air bladder 110 is maintained according to the user's heart rate according to Table 1 minus any delay institute between steps 1120 and 1220 as discussed. In an embodiment, the ECP processor 210 performs step 1225 by keeping track of this time period. In step 1230, the helix air bladder 110 is depressurized. In an embodiment, the depressurization is performed by the ECP processor 210 sending a signal valve 310*a* to disconnect helix air bladder 110 from air compartment 320 to connect helix air bladder 110 to airway 380 in which negative pressure is established to depressurize the air bladder by closing air inlet valve 370 while compressor 350 is running Next, in step 1235, the end of helix air bladder 110 depressurization period is reached. In an embodiment, the ECP processor 210 performs step 1235 by keeping track of this time period. In step 1240, the helix air bladder 110 depressurization process is stopped, and the process repeats from step 1105.

In an embodiment steps 1125 and 1225 are performed about the same time, and steps 1130 and 1230 are also performed about the same time so that both air bladders 110 and 170 are depressurized about the same time. In another embodiment, step 1125 is performed before step 1225, and step 1130 is performed before step 1230 so that the adjunct air bladder 170 is depressurized before the helix air bladder 110. In this embodiment, the delay is about from 20 ms to 100 ms, 30 ms to 90 ms, 40 ms to 80 ms or about 60 ms. In another embodiment, step 1125 is performed after step 1225, and step 1130 is performed after step 1230 so that the adjunct air bladder 170 is depressurized after the helix air bladder 110. In this embodiment, the delay is about from 20 ms to 100 ms, 30 ms to 90 ms, 40 ms to 80 ms or about 60 ms.

If in step 1115 ECP processor 210 determines that air replenishment is required in the air compartments 320 and 340, steps 1120 to 1140 and 1220 to 1240 are performed as described, but steps 1305 to 1315 are also performed to add more air into the system. Specifically, in step 1305, the ECP processor 210 signals valve 370 to open to air inlet 375 and ensures that compressor 350 is running to replenish air to air compartment 340. The air pressure ratio adjustment valve 330 in turn adds air to air compartment 320. In step 1310 as the system reaches end of air replenishment period, in an embodiment, the ECP processor 210 keeps track of the air replenishment period in step 1310. In step 1315, the ECP processor 210 sends signals to close air inlet valve 370 to stop adding air into the valve system. In an embodiment, since air bladder depressurization period requires that valve 370 to be closed so that negative pressure can be established in airway 380, steps 1305 to 1315 are performed concurrently with steps 1120 to 1125 and 1220 to 1225, before steps 1120 and 1220 or after steps 1140 and 1240 are completed.

FIG. 11 illustrate graphically the method of the present invention 1000. As shown in FIG. 11, the R peak is detected in step 1105 and a delay of about 10 ms to about 250 ms, about 50 ms to about 200 ms or about 100 ms to about 150 ms is instituted in step 1110 before the adjunct air bladder 170 is pressurized in step 1120. After the adjunct air bladder 170 is pressurized, the helix air bladder 110 is subsequently pressurized in step 1220 after a delay of about 50 ms. Also seen in FIGS. 11, if replenishment of air is required as determined in step 1115, it is done in steps 1305 to 1315 about the same time as the start of the adjunct air bladder 170 pressurization for about 50 ms to about 100 ms. Subsequently both the adjunct air bladder 170 and the helix air bladder 110 are depressurized at about the same time in steps 1125 to 1140 and in steps 1225 to 1240.

Figure 12:
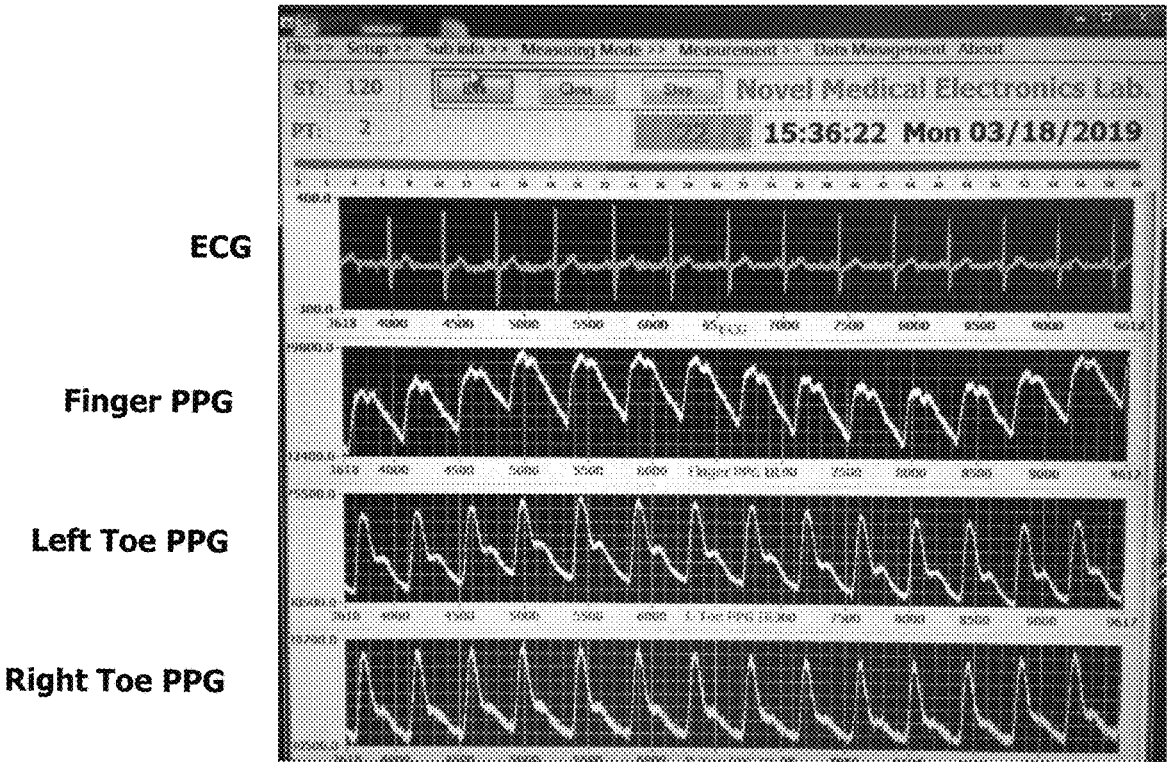
FIGS. 12*a* and 12*b* illustrate an exemplary PPG and ECG signals of a user before and during treatment using the ECP device of the present invention 10, respectively.
Figure 12:
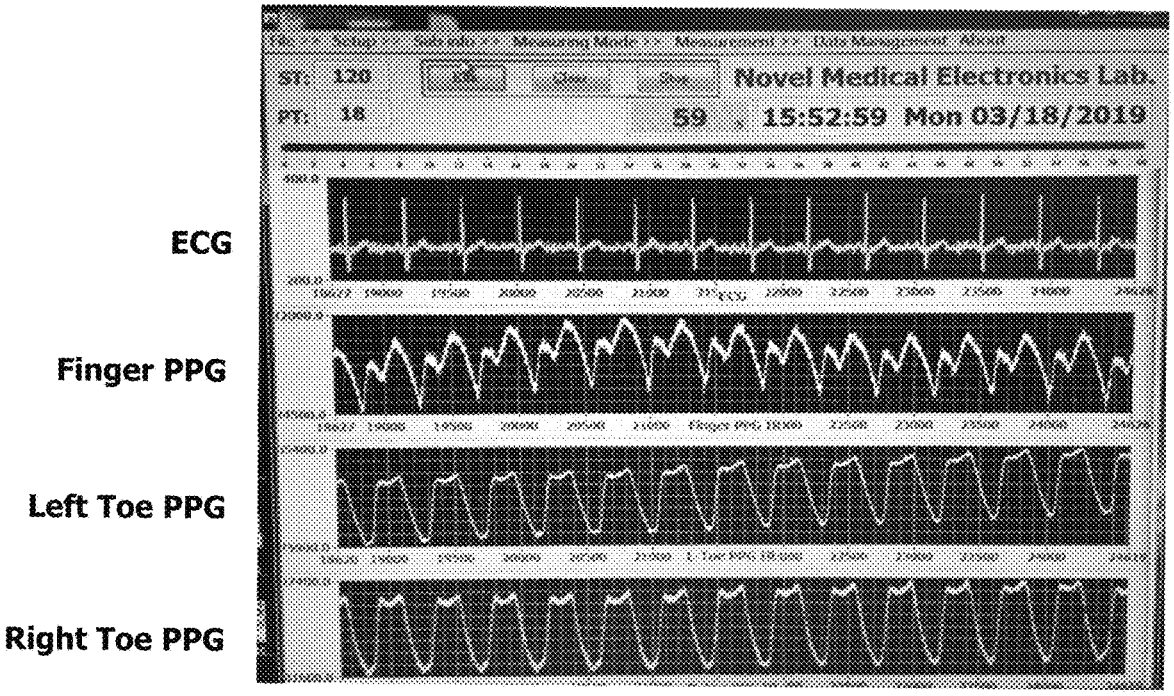
Figure 13:
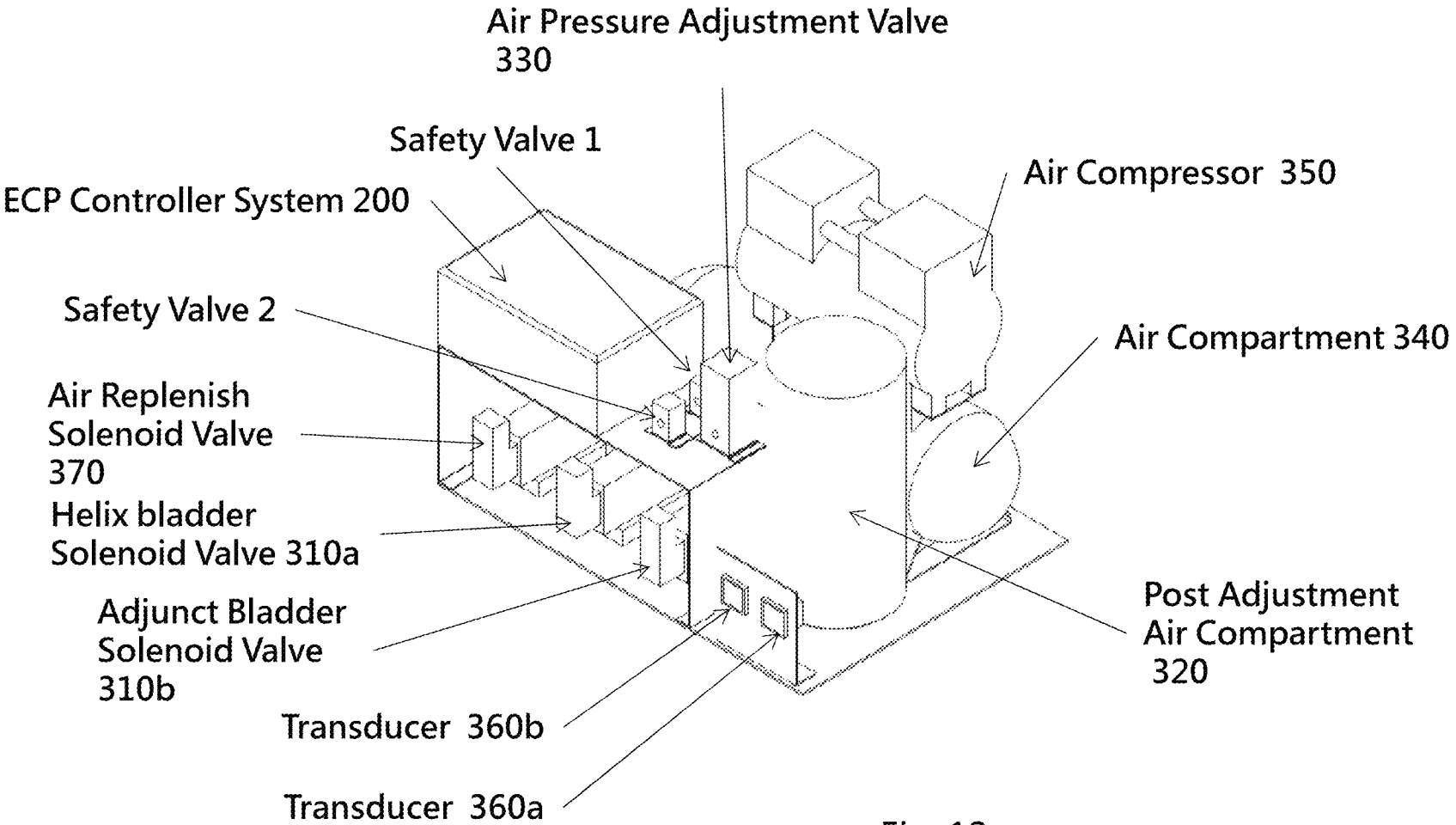
FIG. 13 is a drawing of an exemplary embodiment of the ECP control system 200 and fluid and valves system 300 of the ECP device of the present invention 10.

FIG. 12 illustrates the therapeutic effects of the ECP device 10 of the present invention. As seen in FIG. 12*a*, prior to the treatment, PPG signal of a user is weak. During the treatment, the PPG signal of the user is much more regular and maintained at a constant strength as shown in FIG. 12*b*.

It is to be understood that both the foregoing general description and the following detailed description are exemplary and explanatory only and are not restrictive of the invention, as claimed.

These and other changes can be made to the technology in light of the detailed description. In general, the terms used in the following disclosure should not be construed to limit the technology to the specific embodiments disclosed in the specification, unless the above detailed description explicitly defines such terms. Accordingly, the actual scope of the technology encompasses the disclosed embodiments and all the equivalent ways of practicing or implementing the technology.

What is claimed is:

1. An External Counter Pulsation (ECP) Device comprising:

a. an air bladder system comprising one or more helix air bladders and one or more adjunct air bladders wherein each helix air bladder is adapted to attach to a user's thigh such that the helix air bladder is configured to form a helix around the thigh that closely follows the femoral artery that wrap around the femur bone in a manner that enables the helix air bladder to efficiently exert pressure on the femoral artery against the femur bone when the helix bladder is pressurized to effect blood flow modulation within the major arteries and veins, wherein the ratio of the top width of the helix air bladder W1 to the bottom width W2 of the helix air bladder is about from 1.1:1 to 2:1;

b. a valve and fluid system pneumatically connected to the air bladder system wherein the valve and fluid system is configured to pressurize and depressurize the helix air bladder and the adjunct air bladder; and c. a control system comprising a processor and one or more PPG sensors and one or more ECG sensors wherein the PPG and ECG sensors are connected to the user to collect PPG and ECG signals from the user and wherein the control system is electronically connected to the valve and fluid system to control the valve and fluid system to pressurize or depressurize the air bladders of the air bladder system based on signals detected by the sensors and wherein the adjunct air bladder is positioned at either the lower end or the upper end of the helix air bladder and is pressurized before the helix air bladder so as to direct blood flow towards desired direction.

2. The ECP device of claim 1 wherein the dimensions of the helix air bladder are determined by the anatomy of the user so that the helix air bladder can closely follow the femoral artery of the user's thigh.

3. The ECP device of claim 1 wherein helix air bladder's length L in cm is defined as height of the user/3.2−b where b is between 15 cm to 30 cm and helix angle is about 55°.

4. The ECP device of claim 1 wherein the wattage of the valve system is less than about 1500 Watts.

5. The ECP device of claim 1 wherein the helix air bladder length L does not exceed about 50 cm, top width W1 and bottom width W2 of the helix air bladder do not each exceed about 25 cm and helix air bladder area does not exceed about 1250 $cm^2$.

6. The ECP device of claim 1 wherein the pressure within the helix air bladder does not exceed about 350 mmHg when fully pressurized.

7. The ECP device of claim 1 wherein the pressure of the helix air bladder is not below about 150 mmHg when fully pressurized.

8. The ECP device of claim 1 wherein a helix angle of the helix air bladder is between about 30° and 75°.

9. The ECP device of claim 1 wherein the adjunct air bladder is positioned at the lower end of the helix air bladder with the adjunct air bladder overlapping the helix air bladder.

10. The ECP device of claim 1 wherein the adjunct air bladder is positioned at the lower end of the helix air bladder without the adjunct air bladder overlapping the helix air bladder.

11. The ECP device of claim 1 wherein the adjunct air bladder is positioned at the upper end of the helix air bladder with the adjunct air bladder overlapping the helix air bladder.

12. The ECP device of claim 1 wherein the adjunct air bladder is positioned at the upper end of the helix air bladder without the adjunct air bladder overlapping the helix air bladder.

13. The ECP device of claim 1 wherein the adjunct air bladder and the helix air bladder are in one single cuff.

14. A method for providing external counter pulsation treatment using the ECP device as claimed in claim 1 comprising the steps of:

a. Detecting R peak of a user's heartbeat b. Instituting a delay of about 10 ms to 250 ms from the R peak c. Pressurizing the adjunct air bladder d. Instituting a delay of about 20 ms to 100 ms, e. Pressurizing the helix air bladder for a therapeutically effective amount of time of about 200 ms to 600 ms;

f. Depressurizing both the adjunct air bladder and helix air bladder at about the same time; and g. Repeating steps a-f for a therapeutically effective amount of time therapeutically effective amount of time to therapeutically effectively modulate blood flow.

* * * * *